United States Patent [19]

Amicucci

[11] Patent Number: 4,952,489

[45] Date of Patent: Aug. 28, 1990

[54] PHOTOGRAPHIC ELEMENTS COMPRISING LIGHT-SENSITIVE SILVER BROMO-IODIDE EMULSIONS

[75] Inventor: Marcello Amicucci, Savona, Italy

[73] Assignee: Minnesota Mining and Manufacturing Company, St. Paul, Minn.

[21] Appl. No.: 216,670

[22] Filed: Jul. 8, 1988

[30] Foreign Application Priority Data

Jul. 24, 1987 [IT] Italy ..... 21423 A/87
Jul. 24, 1987 [IT] Italy ..... 21424 A/87
Jul. 24, 1987 [IT] Italy ..... 21447 A/87

[51] Int. Cl.[5] ..... G03C 1/02
[52] U.S. Cl. ..... 430/567; 430/569
[58] Field of Search ..... 430/567, 569

[56] References Cited

U.S. PATENT DOCUMENTS

| | | | |
|---|---|---|---|
| 4,386,156 | 5/1983 | Mignot | 430/567 |
| 4,399,215 | 8/1983 | Wey | 430/567 |
| 4,414,306 | 11/1983 | Wey et al. | 430/434 |
| 4,414,310 | 11/1983 | Daubendiek et al. | 430/567 |
| 4,433,048 | 2/1984 | Solberg et al. | 430/434 |
| 4,434,226 | 2/1984 | Wilgus et al. | 430/567 |
| 4,435,501 | 3/1984 | Maskasky | 430/569 |
| 4,710,255 | 12/1987 | Iguchi et al. | 430/567 |

FOREIGN PATENT DOCUMENTS 1529440 12/1975 United Kingdom .

*Primary Examiner*—Paul R. Michl
*Assistant Examiner*—Thomas R. Neville
*Attorney, Agent, or Firm*—Donald M. Sell; Walter N. Kirn; Mark A. Litman

[57] ABSTRACT

A light-sensitive emulsion layer comprising a dispersing medium and silver halide grains, wherein at least 10% of the total projected area of the silver halide grains is formed by silver bromo-iodide grains bounded by at least one substantially concave-shaped major crystal face, having a diameter of at least 0.6 μm and the half of their thickness, in the deepest point of said concavity, of less than 80% of the half of their border thickness. Photographic elements comprising a support base and at least one such emulsion layer are shown.

Multi-step process for preparing an emulsion of light-sensitive silver halide grains dispersed in a hydrophilic dispersing medium which comprises a first double-jet precipitation step for the formation of silver halide growing nuclei, a second double-jet precipitation step of first diameter growth of said nuclei and a third step of grain second growth by means of single-jet solution of silver salts, characterized by the fact that (a) said first precipitation step for the formation of growing nuclei occurs at a constant pBr ranging from 0.6 to 1.2 in the presence of a soluble chloride to form thick silver halide nuclei, (b) said second step of first growth occurs by adding a first jet of a soluble silver salt water solution at constant concentration and accelerated flow rate and a second jet of a bromide and iodide soluble salt water solution at increasing concentrations of bromide and iodide and constant flow rate at a pBr decreasing from about 1.2 to about 0.6, and (c) said third step of second growth is performed till increasing pBr above 1.2.

For at least 10% of their total projected area the silver halide grains, thus formed, result to be silver bromo-iodide grains bounded by at least one substantially concave-shaped major crystal face, said grains having a diameter of at least 0.6 μm and the half of their thickness, in the deepest point of said concavity, of less than 80% of the half of their border thickness.

50 Claims, 3 Drawing Sheets

PHOTOGRAPHIC ELEMENTS COMPRISING LIGHT-SENSITIVE SILVER BROMO-IODIDE EMULSIONS

FIELD OF THE INVENTION

The present invention refers to photographic emulsions and elements which comprise light-sensitive silver bromo-iodide emulsions and, more particularly, to emulsions wherein at least 10% of the total projected area of silver bromo-iodide grains is formed by silver bromo-iodide grains bounded by at least one substantially concave-shaped major crystal face, and a process for forming light sensitive silver bromo-iodide emulsions.

BACKGROUND OF THE ART

Light-sensitive silver halide photographic emulsions, used in photography to obtain black and white and color images, consist of light-sensitive silver halide grains dispersed in a hydrophilic dispersing medium. The silver halide grains used in photography typically consist of silver chloride, silver bromide, silver iodide, silver chloro-bromide, silver bromo-iodide, silver chloro-iodide and silver chloro-bromo-iodide. In general, silver bromo-iodide emulsions are more widely used in camera speed photographic elements, such as color photographic elements. Although silver bromo-iodide grains can contain up to 40% iodide moles, which is the solubility limit of silver iodide in silver bromide, lower iodide quantities (e.g. quantities lower than about 20% iodide) are in general used.

Silver halide grains of photographic emulsions have a wide variety of grain shapes. They can have a regular shape, such as cubical or octahedrical, an irregular shape, such as those grains having rounded edges due to ripening effects, or a more or less spherical shape, such as those obtained in the presence of strong ripening agents such as ammonia (see e.g. U.S. Pat. No. 3,894,871 and Zelikman and Levi, *Making and Coating Photoqraphic Emulsions,* Focal Press, 1964, p. 223).

Tabular silver halide grains, which have two major parallel crystal faces, are known in the art of photography. They have been deeply studied for photographic use e.g. by deCugnac and Chateau, *Evolution of the Morphology of Silver Bromide Crystals During Physical Ripening,* Science et Industries Photographiques, vol. 33, no. 2, 1962, p. 121–125, by Gutoff, *Nucleation and Growth Rates During Precipitation of Slver Halide Photographic Emulsions,* Photographic Sciences and Engineering, vol. 14, no. 4, 1970, p. 248–257, in U.S. Pat. Nos. 4,063,951; 4,067,739; 4,150,994; 4,184,877; 4,386,156; 4,434,226; 4,399,215; 4,425,425; 4,400,463; 4,414,306; 4,433,048; 4,478,929 and 4,439,520, in British patent No. 1,150,581 and in German patent applications Ser. Nos. 2,905,655 and 2,921,077.

In the art of light-sensitive silver halide photographic materials, in particular of light-sensitive silver halide photographic materials for color photography, such materials are desired to meet various needs, such as speed, a good image quality (excellent granularity, high definition, low diffusion), a low fog density, excellent latitude in light exposure, sufficiently high optical density, etc. Recently, such needs have become more and more rigid and many improvement techniques have been therefore proposed for use in photographic materials.

In general, in the preparation of light-sensitive silver halide photographic materials, speed and image quality are antagonistic to each other. For example, if speed is increased by increasing the size (volume) of silver halide grains, a decrease in image quality (higher granularity) is often caused. On the other hand, if image quality is to be improved by decreasing the silver halide grain thickness (lower diffusion), thin transparent grains are obtained which have a poor photon-absorption capability and therefore poor sensitivity. The adsorption, on the surface of such grains of sensitizing dye molecules up to a complete coverage of the surface of each single grain by means of a monolayer of such molecules, would make such grains capable of better photon absorption, but the solution of the problem has not yet been described (see The Vogel Centennial, *Dye-Sensitization Past and Future,* Aug. 26–30, 1973, with particular reference to G. R. Bird's final reading). Consequently, it is highly desirable to provide silver halide photographic elements which allow to obtain both improved sensitivity and image quality.

SUMMARY OF THE INVENTION

Photographic emulsions and photographic elements which comprise a support base and at least one light-sensitive emulsion layer comprising a dispersing medium and silver halide grains, wherein at least 10% of the total projected area is formed by silver bromo-iodide grains bounded by at least one substantially concave-shaped major crystal face, having a diameter of at least 0.6 μm and the half of the thickness, in the deepest point of said concavity, of less than 80% of the half of their border thickness.

The photographic elements of the present invention offer significant advantages in the photographic characteristics. The silver bromo-iodide emulsions contained in said elements can be easily chemically and spectrally sensitized to obtain the required sensitivity for photographic applications. Said silver bromo-iodide emulsions reduce light diffusion with an increase of image sharpness. Still other advantages can be obtained according to the specific photographic applications.

Also disclosed is a multi-step process for preparing an emulsion of light-sensitive silver halide grains dispersed in a hydrophilic dispersing medium which comprises a first double-jet precipitation step for the formation of silver halide growing nuclei, a second double-jet precipitation step of first diameter growth of said nuclei and a third step of grain second growth by means of single-jet solution of silver salts, characterized by the fact that (a) said first precipitation step for the formation of growing nuclei occurs at a constant pBr ranging from 0.6 to 1.2 in the presence of a soluble chloride to form thick silver halide nuclei, (b) said second step of first growth occurs by adding a first jet of a soluble silver salt water solution at constant concentration and accelerated flow rate and a second jet of a bromide and iodide soluble salt water solution at increasing concentrations of bromide and iodide and constant flow rate at a pBr decreasing from about 1.2 to about 0.6, and (c) said third step of second growth is performed till increasing pBr above 1.2.

For at least 10% of their total projected area the silver halide grains, thus formed, result to be silver bromo-iodide grains bounded by at least one substantially concave-shaped major crystal face, said grains having a diameter of at least 0.6 μm and the half of their thickness, in the deepest point of said concavity, of less than 80% of the half of their border thickness.

The silver bromo-iodide emulsions of the process of the present invention offer significant advantages in the photographic characteristics. Said silver bromo-iodide emulsions can be easily chemically and spectrally sensitized to obtain the required sensitivity for photographic applications. Said silver bromo-iodide emulsions reduce light diffusion with an increase of image sharpness. Still other advantages can be obtained according to the specific photographic applications.

DETAILED DESCRIPTION OF THE INVENTION

Figure 1:
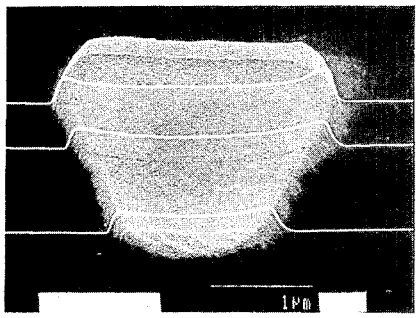
Figure 2:
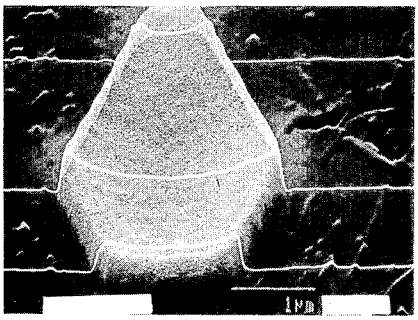
Figure 3:
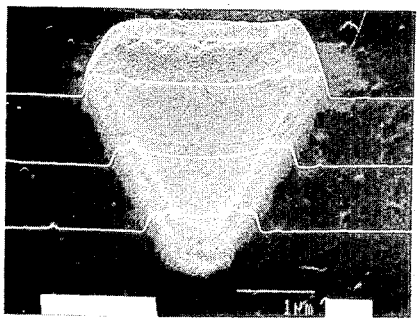
Figure 4:
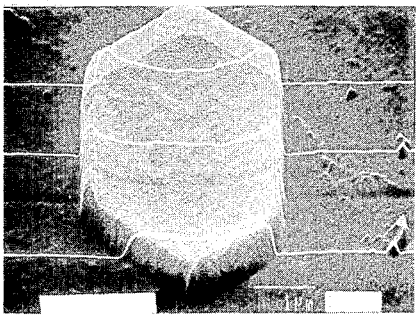

A. Photographic elements.

The present invention refers to photographic elements which comprise a support base and at least one silver halide grain emulsion layer, wherein at least 10% of the total projected area of said silver halide grains is formed by silver bromo-iodide grains bounded by two opposite major crystal faces, at least one of said surfaces and preferably both crystal faces having a substantially concave shape, and having a diameter of at least 0.6 μm and the half of the thickness, in the deepest point of said concavity (determined as described hereinbelow), lower than 80% of the half of their border thickness.

B. Silver Bromo-Iodide Emulsions.

The present invention refers to light-sensitive emulsions which comprise a dispersing medium and silver halide grains, wherein at least 10% of the total projected area of the silver halide grains is formed by silver bromo-iodide grains bounded by two opposite major crystal faces, at least one of said surfaces and preferably both crystal faces having a substantially concave shape, and having a diameter of at least 0.6 μm and the half of the thickness, in the deepest point of said concavity (determined as described hereinbelow), lower than 80% of the half of their border thickness.

C. Process for Preparing Silver Bromo-Iodide Emulsions.

The present invention refers to a multi-step process for preparing an emulsion of light-sensitive silver halide grains dispersed in a hydrophilic dispersing medium which comprises a first double-jet precipitation step for the formation of silver halide growing nuclei, a second double-jet precipitation step of first diameter growth of said nuclei and a third step of grain second growth by means of single-jet solution of silver salts, characterized by the fact that (a) said first precipitation step for the formation of growing nuclei occurs at a constant pBr ranging from 0.6 to 1.2 in the presence of a soluble chloride to form thick silver halide nuclei, (b) said second step of first growth occurs by adding a first jet of a soluble silver salt water solution at constant concentration and accelerated flow rate and a second jet of a bromide and iodide soluble salt water solution at increasing concentrations of bromide and iodide and constant flow rate at a pBr decreasing from about 1.2 to about 0.6, and (c) said third step of second growth is performed till increasing pB above 1.2.

In the present invention, the term "projected area" is used to mean the effective area which the grain offers as an obstacle to a parallel light beam impinging it and the term "total projected area" is used to mean the sum of the projected areas of all grains in the silver halide emulsion. In the art, such term is used instead of the grain size distribution for purposes of correlation with the photographic characteristics; see e.g. James and Higgins, Fundamental of Photographic Theory, J. Wiley & Sons, New York, 1948, p. 15. According to the conditions chosen to prepare the emulsion of the present invention, in addition to the above mentioned silver bromo-iodide grains other grain families may be present, such as tabular grains (both thick and thin grains), nontabular grains, rod-like grains. It is however preferred to increase the number of the above mentioned silver bromo-iodide grains such as to make up at least 30%, more preferably at least 50% and most preferably at least 70% of the total projected area of the silver halide grains.

In the determination of the grain characteristics a reference diameter of at least 0.6 μm has been chosen since the characteristics of the grain surface cannot be easily ascertained with shorter diameters. As known in the art, the grain diameter is defined as the diameter of a circle having the same area as the projected area of said grain.

In the present invention, silver bromo-iodide grains have two opposite crystal faces, each of which is substantially larger than any other single face of the grain. Said grains are characterized by being significantly thinner in the middle than at the border. At the border they preferably have a thickness of at least 0.15 μm, more preferably of at least 0.2 μm, having preferably a thickness lower than 0.4 μm and more preferably lower than 0.35 μm, the thickness in the middle being lower than 80% the thickness at the border, preferably lower than 60%. The grain is preferred not to have any hole in the middle since a high grain surface with respect to volume is desired.

If the grains of the photographic elements of the present invention are positioned above a horizontal plane on one of their larger faces, their projections on that horizontal plane show the dimension of such grains in the two conventional dimensions of the horizontal plane, x and y, which are substantially greater than their thickness measured as a projection on the third dimension, z, of the space. If a grain is cut along a vertical plane (normal to the x,y plane) passing through the center of the crystal (which is conventionally placed at x, y and z=0) and looked at along the perpendicular direction to that plane, a section profile of the grain can be imagined to be obtained which is characterized by the fact of being higher at the periphery of the crystal and very low around the center and growing higher and higher from the center to the periphery. For conventional reasons, the vertical plane passing through the center in correspondence with the shortest diameter of the crystal is assumed to be chosen.

Figure 6:
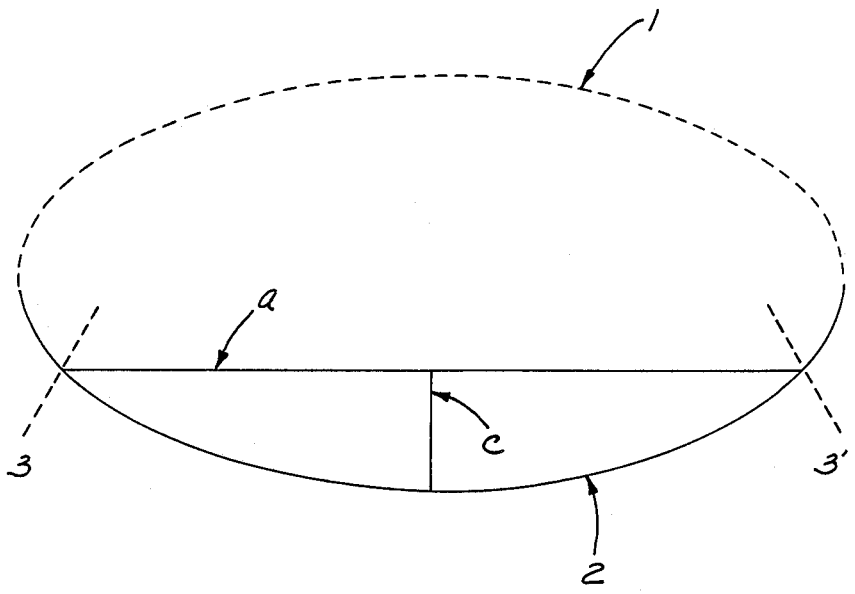

The shape of said section profile of the grain can be described as being approximately equivalent to a flattened half-ellipse cut along the longer axis or, better, as a substantial portion of the half-ellipse which can be obtained by removing the two end portions of said flattened half-ellipse and with reference to its longer axis and to the half of the shorter one, herein respectively indicated with a and c. FIG. 6 shows an ellipse (1) where the continuous-line portion (2) represents the half-ellipse cut along the longer axis, the portion of which delimited by (3) and (3') is schematically used to describe the section profile of at least one substantially concave-shaped face of the grain of the present invention. Such an approximate half-ellipse is used to describe the concavity shape on at least one of the two larger faces of the grain itself. Thus, if the thickness half (at the ends of the measured diameter) of the grain is indicated with b/2, the thickness half in the ellipse middle coincides with the deepest point of concavity c of the grain and is indicated with b/2-c (where b/2 value is measured as the distance between the horizontal plane subtending the crystal concavity and the horizontal plane (x,y) passing through the center of such crystal). The possible values of the relative depth of such concavity, indicated with c/a (concavity ratio), will depend upon the "aspect ratio" (as defined hereinbelow) of the grain and respond to the conditions $c>b/10$ and $c<b/2$.

The concavity may take up not the whole area of the larger face, thus giving rise to an outward frame having a more or less uniform thickness and extending normally to less than 20% the total area of the considered face. The average section thickness of such frame corresponds to thickness b, already indicated, of the considered grain. The diameter a considered to the purposes of the present invention does not include the portion of the crystal diameter which corresponds to the frame itself.

The silver bromo-iodide grains of the photographic elements of the present invention have an average "aspect ratio" of at least 2:1, preferably of at least 4:1, preferably lower than 10:1, more preferably lower than 8:1, said "aspect ratio" being the ratio between the diameter (calculated as follows) and thickness of the grain at the border. To the specific purposes of calculating the "aspect ratio", the diameter d of the grains is defined as the diameter of a circle having the same area as that projected by the grain as seen in a photograph at the electronic microscope of an emulsion sample. In practice, said "aspect ratio" is measured as mean value and is the ratio between the average diameter d of all concave-shaped grains having a diameter of at least 0.6 μm and the average diameter b at the border of said grains, obtained from shaded photographs at the electronic microscope of emulsion samples containing said grains dispersed in gelatin. Correspondingly to each preferred mean "aspect ratio" value of an emulsion of the present invention, the preferred mean concavity ratio range can be calculated by comparing it with conditions $c>b/10$ and $c<b/2$. For instance, a mean "aspect ratio" of 4:1 gives $1/40<c/a<1/8$ and an "aspect ratio" of 8:1 gives $1/80<c/a<1/16$. The "aspect ratio" values between 4:1 and 8:1 correspond to the more general condition $1/80<c/a<1/8$. Similarly, "aspect ratio" values between 2:1 and 10:1 correspond to general condition $1/100<c/a<1/4$.

D. Process for Preparing Silver Bromo-Iodide Emulsions.

The silver bromo-iodide emulsions of the photographic elements of the present invention can be prepared according to the following multi-step precipitation method.

A dispersing medium and water-soluble chloride salts are introduced into a conventional reaction vessel for silver halide precipitation, provided with an efficient stirring device.

The dispersing medium in general is a peptizer dispersion in water. Peptizers can be chosen among those normally used in silver halide emulsions. Preferred peptizers include hydrophilic colloids which can be used alone or in combination with other hydrophilic or hydrophobic compounds. Suitable hydrophilic colloids comprise gelatin, such as alkali or acid-treated gelatin, gelatin derivatives, such as phthalated or acetylated gelatin, proteins, protein derivatives, polysaccharides such as dextran, gum arabic, casein, pectin, cellulose derivatives, and the like. Other compounds generally used in combination with hydrophilic colloidal peptizers comprise synthetic polymeric binders, such as acrylamide polymers, polyvinyl lactames, polyvinyl alcohols, polyvinyl acetals, alkyl and sulfoalkyl acrylate and methacrylate polymers, acrylic acid polymers, maleic acid polymers, and the like.

At the beginning of silver halide precipitation the dispersing medium is not necessary to be present all in the reaction vessel. At the beginning, lower quantities of the total dispersing medium, such as at least 10%, preferably from 20 to 80% by weight with respect to the total weight of the dispersing medium present at the end of silver bromo-iodide grain precipitation are generally introduced into the reaction vessel and the remaining portion is added in subsequent precipitation steps.

Water soluble chloride salts, present in the reaction vessel at the beginning of precipitation, include ammonium, alkali metal (sodium, potassium or lithium) and alkali-earth metal (magnesium or calcium) chlorides. Typically, said chloride salts are present in quantities from 0.02 to 0.15 moles per mole of the total silver salt in the formula.

At the beginning, in the reaction vessel there are present lower quantities of the bromide salt used in the formation of bromo-iodide grains of the emulsions of the present invention to adjust pBr (i.e. negative logarithm of bromide ion concentration) of the dispersing medium at the beginning of precipitation. At the beginning, pBr of the dispersing medium is in the range from 0.6 to 1.2.

Silver and bromide ions are double-jet added during a first precipitation step into the reaction vessel following techniques well-known in the art. Typically, a water solution of a water-soluble silver salt, such as silver nitrate, is introduced together with a water solution of a water-soluble bromide salt, such as ammonium, alkali metal (sodium, potassium or lithium) or alkali-earth metal (magnesium or calcium) bromide salt. The silver and bromide salt concentration is preferably in the range from 0.1 to 5 moles per liter, even if, as known, wider concentration ranges can be chosen. The introduction rate of the silver and bromide salt is preferably constant and the pBr during the simultaneous introduction of silver and bromide salts is preferably kept constant in the above indicated range.

From about 2 to about 10% of the total silver is preferably used in this first nucleation step. During this nucleation step, the first fine silver bromide nuclei are grown up to thick silver bromide nuclei having two larger substantially parallel opposite faces with a mean diameter in the range from 0.2 μm to about 1.0 μm and a mean "aspect ratio" lower than 8:1, preferably lower than 5:1. The presence of water-soluble chloride salts at the beginning of precipitation is deemed to be essential for the formation of such thick silver bromide nuclei.

In a second step, pBr is raised to about 1.2 and silver, bromide and iodide are concurrently added into the reaction vessel. Silver salt is added at a constant concentration and continuously increasing addition rate, while bromide and iodide salts are added at an increasing concentration and constant addition rate. At the end of such step, pBr is lowered substantially to the same values of the growth stage and from 10 to 40% of total silver is used.

In this second step, silver salt is added in the reaction vessel preferably at a constant concentration in the range from 0.1 to 3 moles per liter, more preferably from 0.5 to 2 moles per liter and an accelerated addition rate preferably in the range from 2x to 10x, more preferably from 4x to 8x. Concurrently with the silver salt addition, bromide salts are added in the reaction vessel at a constant addition rate and increasing concentration, from the beginning to the end of addition, preferably from 1 to 8 moles per liter, more preferably from 1.5 to 6 moles per liter and iodide salts at a constant addition rate and increasing concentration preferably from 0 to 2 moles per liter, more preferably from 0 to 1 mole per liter.

Various methods can be used to achieve the addition of bromide and iodide salts at a constant addition rate and increasing concentration according to the present invention. According to a preferred method, this is obtained by adding bromide and iodide salts, at a constant or accelerated addition rate, from a first tank containing bromide and iodide salts into a second tank containing bromide salts and adding at the same time halide salts from the second tank to the reaction vessel at a constant addition rate. According to a more preferred method, the above addition can be achieved by feeding with pumps two solutions, viz. a solution of bromide and iodide salts and another solution of bromide salts, from two separated tanks and mixing the two solutions prior to adding them into the reaction vessel. By using proper deliveries of the two pumps, it is possible with this latter method to achieve a state of the bromide and iodide concentration changes according to that achieved with the former method.

In a further third step, silver salt is single jet added using 50 to 88% of the total silver and pBr is increased above 1.2.

The iodide concentration in the grains of the silver bromo-iodide emulsions of the photographic elements of the present invention can be controlled by adding iodide salts. In general in photographic applications the iodide concentration maximum is preferred to be limited to about 20% moles, more preferably to about 15% and most preferably in the range from 3 to 10% iodide moles.

The silver bromo-iodide grains of the emulsions of the photographic elements of the present invention show a varying iodide concentration profile. In general, they have a central (or nuclear) region with an iodide concentration lower than the average concentration, a middle region with a iodide concentration higher than the average concentration and an outermost silver bromide shell substantially free of iodide.

During the silver halide precipitation, in the reaction vessel there may be present other compounds, used in the art, from the beginning and/or added afterwards with the salts. Such compounds comprise modifiers, such as copper, lead, tallium, cadmium, zinc, intermediate chalcogens (sulfur, selenium or tellurium), gold and noble metals, and ripening agents, for instance silver halide solvents such as thiocyanate salts and thioethers.

The silver bromo-iodide emulsions of the photographic elements of the present invention are preferably washed to remove soluble salts. The washing techniques known in the art can be advantageously used, such as decantation, filtration, frozen emulsion washing, coagulated emulsion washing, centrifugation, use of hydrocyclones, diafiltration with semi-impermeable membranes, use of ionic exchange resins, and the like.

E. Chemical sensitization.

The silver bromo-iodide emulsions of the photographic elements of the present invention can be chemically sensitized as known in the art. For instance, they can be chemically sensitized with active gelatins, with sulfur, selenium, tellurium, gold, platinum, palladium, iridium, osmium, rhodium or phosphor sensitizers, or with combinations of such sensitizers, with reducing agents, such as hydrogen, stannous chloride, thiourea dioxide, polyamines and aminoboranes. Methods for chemically sensitizing the silver bromo-iodide emulsions are described in Research Disclosure 17643, III, December 1978.

Preferably, the silver bromo-iodide emulsions of the photographic elements of the present invention are chemically sensitized with sulfur and gold sensitizers, with selenium and gold sensitizers, or with sulfur, selenium and gold sensitizers, more preferably at a pAg (wherein pAg is the negative logarithm of the concentration of silver ions) from 5 to 10, at a pH (wherein pH is the negative logarithm of the concentration of hydrogen ions) from 5 to 8 and at a temperature from 30° to 80° C. Chemical sensitization can be advantageously performed in the presence of ripening agents, such as thiocyanates, preferably in a concentration from about $2\times10^{-3}$ to 2% moles with respect to silver.

F. Spectral sensitization.

Further to being chemically sensitized, the silver bromo-iodide emulsions of the photographic elements of the present invention are also spectrally sensitized by using spectral sensitizing dyes which absorb in the blue, red and green region of the spectrum. For special photographic applications spectral sensitizing dyes can even be used which absorb in a region beyond the visible range, such as for example sensitizing dyes which absorb in the infrared region.

For spectrally sensitizing the bromo-iodide emulsions of the photographic elements of the present invention spectral sensitizing dyes can be advantageously used which belong to the polymethine dye class comprising cyanines, merocyanines, oxonols, hemioxonols, styryls, merostyryls and streptocyanines.

The spectral sensitizing dyes of the cyanine type comprise two basic heterocyclic nuclei linked by a methine chain. The heterocyclic nuclei, for example, are those derived from the quaternary salts of quinoline, pyridine, isoquinoline, oxazole, thiazole, selenazole, benzimidazole, benzoxazole, benzothiazole, benzoselenazole, naphthoxazole, naphthothiazole, naphthoselenazole, 3H-indole, and the like.

The spectral sensitizing dyes of the merocyanine type comprise a basic heterocyclic nucleus of the type used in cyanines and an acid nucleus linked by a methine chain. Acid nuclei, for instance, are those derived from barbituric acid, 2-thiobarbituric acid, rhodanine, hydantoine, thiohydantoine, 2-pyrazolin-5-one, 2-isoxazolin-5-one, indan-1,3-dione, cyclohexan-1,3-dione, 1,3-dioxan-4,6-dione, pyrazolin-3,5-dione, pentan-2,4-dione, alkylsulfonylacetonitrile, malononitrile, isoquinolin-4-one, chroman-2,4-dione, and the like.

Spectral sensitizing dyes are known having a wide variety of sensitization maxima and spectral sensitization curve shapes. The man skilled in the art can choose the types and relative proportions of the sensitizing dyes according to the spectrum region to which sensitization is desired and to the desired spectral sensitization curve.

Among the spectral sensitizing dyes useful to sensitize silver bromo-iodide emulsions there are those described in Research Disclosure 17643, IV J, December 1978.

Combinations of spectral sensitizing dyes and other additions which give supersensitization effects can be used. Additions which, once combined with the spectral sensitizing dyes, give supersensitization effects are for instance stabilizers and antifoggants, development accelerators and inhibitors, coating aids, brighteners, antistatic agents, as described for instance in Research Disclosure 17643, IV E, December 1978.

The spectral sensitizing dyes are preferably adsorbed on the grain surface of the silver bromo-iodide emulsions of the present invention in a substantially optimal quantity, i.e. in a quantity sufficient to realize at least 60% of the highest photographic sensitivity which can be obtained with such emulsions. Said quantity will vary according to the specific dye or dye combination, as well as to the grain sizes. As known in the art, an optimal photographic sensitivity is obtained with spectral sensitizing dyes which cover from about 25% to 100% or more of the whole grain surface with a monolayer, as described for instance in U.S. Pat. No. 3,979,213 and in Mees, The Theory of the Photographic Process, 1942, MacMillan, pages 1067–1069.

Spectral sensitization can be performed in any step of emulsion preparation to be useful as known in the art. Typically, spectral sensitization can be performed after chemical sensitization or can precede it or can even be started prior to completing precipitation of the silver halide grains, as described for instance in U.S. Pat. Nos. 3,268,960 and 4,225,666. It is even possible to introduce a part of the sensitizing dye prior to chemical sensitization and the remaining part after chemical sensitization.

After having been formed by precipitation, washed and sensitized as described hereinbefore, the silver bromo-iodide emulsions of the photographic elements of the present invention can be added with the conventional photographic additions and used in photographic applications where a silver image is required to be formed, such as in conventional black and white photography.

Silver bromo-iodide emulsions may incorporate hardeners for cross-linkable colloids, in particular for gelatin. The hardeners can be used alone or in combination and in a free or blocked form. Several organic or inorganic hardeners can be used, such as those described in Research Disclosure 17643, December 1978, X.

The silver bromo-iodide emulsions can be protected against fog (which is the instability causing the increase of minimum density) by incorporating in the emulsion stabilizers, antifolding agents, latent image stabilizers and the like, as described in Research Disclosure 17643, December 1978, VI.

Several other additions can be incorporated in the silver bromo-iodide emulsions, further to chemical and spectral sensitizers, hardeners, antifoggants and stabilizers. The specific choice thereof depends upon the exact nature of the photographic application. Useful photographic additions are described for example in Research Disclosure 17643, December 1978, such as absorbing or diffusing materials, as described in paragraph VIII, coating aids, as described in paragraph XI, plasticizers and lubricants, as described in paragraph XII, matting agents, as described in paragraph XVI, developing agents and development modifiers, as described in paragraphs XX and XXI. The emulsions, as well as other silver halide emulsion layers, sub-layers, interlayers and protective layers, if present in the photographic element, can be coated and dried by following procedures as those described in paragraph XV of Research Disclosure 17643, cited above.

The silver bromo-iodide emulsions of the photographic elements of the present invention can be used in a blend with conventional silver halide emulsions to meet particular needs of the photographic elements including them. In the photographic art it is known to blend silver halide emulsions to adjust the characteristic curve of the element as desired by controlling maximum and minimum densities, general speed and contrast of the exposed and processed element. Silver halide emulsions suitable to be blended with the silver bromo-iodide emulsions of the present invention are for instance those described in Research Disclosure 17643, cited above, paragraph I and in U.S. Pat. Nos. 3,140,179 and 3,152,907.

The light-sensitive photographic elements of the present invention comprise at least one single emulsion layer including the silver bromo-iodide emulsion of the present invention coated onto a photographic support base. The photographic elements of the present invention may include more than one silver halide emulsion layer, as well as other layers, such as sub-layers, intermediate layers and protective layers. The emulsion blending effect, as described above, can be advantageously obtained by coating the emulsions as separate layers. It is common practice in photography to increase the sensitivity of photographic elements by coating faster and slower emulsions as separate layers, the faster emulsion layer being typically coated closer to the radiation source than the slower emulsion layer.

The layers of the photographic elements can be coated on a variety of support bases. Typical support bases comprise polymeric films, papers, metal sheets, glass and ceramic supports, such as those for example described in Research Disclosure 17643, cited above, paragraph XVII, in BE patent No. 881,513 and in U.S. Pat. No. 4,307,165.

The photographic elements of the present invention can be image-wise exposed to several forms of energy, as described in Research Disclosure 17643, cited above, paragraph XVIII.

The light-sensitive silver halide emulsions contained in the photographic elements can be processed after having been exposed to obtain a visible image by using formulations and techniques described for instance in Research Disclosure 17643, cited above, paragraph XIX.

G. Color photographic elements.

The above described photographic elements and techniques to obtain silver images can be adapted to give color images. Said color photographic elements, as known in the art, form dye images upon image-wise dye destruction, formation, diffusion or physical removal.

The photographic elements can produce dye images upon image-wise destruction of dyes or dye precursors, such as silver-dye bleaching processes, illustrated in Research Disclosure 17643, cited above, paragraph VII B.

The photographic elements can produce dye images upon image-wise dye formation, such as reaction (coupling) of a color developing agent (e.g. a primary aromatic amine) in its oxidated form with a dye forming coupler. The dye forming couplers can be incorporated in the photographic elements as illustrated in Research Disclosure 17643, cited above, paragraph VII C.

In a common form, dye forming couplers are chosen to form primary substractive dyes (yellow, magenta and cyan) and are non-diffusing, colorless couplers, such as two- or four-equivalent couplers of the open-chain ketomethylene, pyrazolone, pyrazolotriazole, phenol or naphthol type, provided with hydrophobic ballasting groups to be incorporated in high-boiling organic solvents. Such couplers are described in Research Disclosure 17643, cited above, paragraph VII D.

The photographic elements may incorporate ballasted alkali-soluble couplers or may be adapted to form non-diffusing dyes which employ dye forming couplers in the developing solutions, as described in Research Disclosure 17643, cited above, paragraph VII E.

Dye forming couplers upon coupling may release photographically useful fragments, such as development inhibitors or accelerators, bleaching accelerators, developing agents, silver halide solvents, silver dyes, hardeners, fogging agents, antifoggants, competing couplers, chemical or spectral sensitizers or desensitizers, as described in Research Disclosure 17643, cited above, paragraph VII F.

The photographic elements may incorporate dye-forming colored couplers, such as those used to form integral masks for color negative images, as described in Research Disclosure 17643, cited above, paragraph VII G.

The photographic elements can produce color images upon image-wise dye removal, as described in Research Disclosure 17643, cited above, paragraph VII H.

The photographic elements can produce color images by using image transfer processes based on the image formation in an image recording layer and image-wise diffusion of at least one material from said layer to form an image in an adjacent image-receiving layer and/or leave a residual material image-wise distributed in said image recording layer, as described in Research Disclosures 15162, November 1976 and 12331, July 1974.

The photographic elements may contain anti-stain agents and color image stabilizers, as described in Research Disclosure 17643, cited above, paragraphs VII I and J.

The photographic elements may be processed to form color images which correspond to or are reversed with respect to the silver halide made selectively developable upon image-wise exposure with techniques described in Research Disclosure 17643, cited above, paragraphs XIX C-J.

In particular, the present invention refers to multicolor photographic elements which produce multicolor images from the combination of image-forming primary substractive dyes. Such photographic elements typically comprise a support base and at least three silver halide emulsion layers coated one upon the other to record separately yellow, magenta and cyan dye images upon exposure to blue, green and red light, respectively.

The silver bromo-iodide grains bound by two opposite concave-shaped major faces are comprised in at least one of the emulsion layers, destined to record blue, green or red light, of the photographic elements according to the present invention, the other layers comprising conventional silver halide emulsions, as described in Research Disclosure 17643, cited above, paragraph I. In a preferred form, all emulsion layers comprise the silver bromo-iodide grains of the present invention. In a more preferred form, if there are more than one emulsion layer to record the blue and/or green and/or red light, at least the fastest emulsion layer contains the silver bromo-iodide grains of the present invention.

The multicolor photographic elements are in general described in terms of three color-forming layer units coated one upon the other, every unit containing at least one emulsion layer capable of recording exposure at one third of the spectrum and producing a primary substractive dye complementary image. Color forming layer units recording blue, green and red are in general used to produce yellow, magenta and cyan images, respectively. Although every color forming unit can contain a single emulsion layer, in a single color forming unit there are often incorporated two, three or more different photographic speed emulsion layers. In general, one single color forming unit comprises multiple different photographic speed emulsion layers. If the arrangement of the layer order does not allow this, it is common practice to provide one single photographic element of two or more blue and/or green and/or red color forming units.

In the art of multicolor photographic elements there are described many arrangements of the layer order, such as those described by Gorokhovskii, Spectral Studies of the Photographic Process, Focal Press, New York, page 211 and any other possible useful arrangement. A preferred form of the present invention describes an arrangement of the layer order in which the faster emulsion layers of each color forming unit are closer to the exposing radiation source, the support base being normally positioned farther from the radiation source. In a more preferred form, at least the faster emulsion layer of the color forming unit closer to the exposing radiation source comprises the silver bromo-iodide grains as described above. In a most preferred form, each faster emulsion layer of each color forming unit comprises the silver bromo-iodide grains as described above.

H. Reduction of light scattering.

The silver bromo-iodide emulsions of the photographic elements of the present invention, besides being easily chemically and spectrally sensitized, are advantageous for their lower light scattering at high angles with respect to non-tabular and low aspect ratio tabular grain emulsions. The method for measuring light scattering by silver halide emulsions is based on goniophotometric measurements of the light transmitted by a sample, as described by De Belder, De Kerf, Jesper and Verbrugghe, Journal of Optical Society of America, 1965, page 1261. According to such a method, an emulsion sample is coated onto a transparent support base and dried. The emulsion coated on the support base is mounted, dipped into a liquid having a suitable refraction index, onto a glass semicylinder. The sample is lighted with parallel monochromatic light. Owing to the emulsion scattering capability, photons are scattered in different directions. Light passing through the emulsion and base can be detected by a photodetector, such as a photodiode, at a constant distance from the emulsion on a semispheric detecting surface. The current, produced by the photodetector, is measured with respect to the angle between the normal to the sample and the photodetector direction. The signal results to be proportional to the light stream impinging onto the sensitive region of the photodetector and therefore to scattered light. By plotting on a graph the relative signal collected in an angle range from 0° to 90°, the distribution of the angular radiant intensities is obtained. The higher the signal relative to wide angles (e.g. wider than 20°), the higher is light scattering. Since scattering at wide angles of light passing through an emulsion layer undesirably contributes to decrease image sharpness, the silver bromo-iodide emulsions of the present invention result to be able to produce sharper images.

The advantages of sharpness increase of a silver halide emulsion layer coated under the silver bromo-iodide emulsion layer of the present invention are fully obtained if the silver bromo-iodide emulsion layer is preferably positioned such as to receive light transmitted in a substantially specular way, that is to receive substantially not scattered light. In multicolor photographic elements containing color forming units coated one upon the other, to obtain the sharpness advantages at least the emulsion layer closer to the radiation source is preferred to be the bromo-iodide emulsion layer of the present invention. In a preferred specific form each emulsion layer of each color forming unit closer to the radiation source is the silver bromo-iodide emulsion layer of the present invention.

The following examples better illustrate the present invention.

EXAMPLE 1

Preparation of the Silver Halide Emulsion (a) Formation of Thick Nuclei - 5 liters of a gelatin water solution (3.2% w/w gelatin solution containing 0.2 mole potassium bromide and 0.4 mole potassium chloride) at 80° C. and pBr 0.70 contained in a reaction vessel were double-jet added with 116.6 ml of a 0.8 molar silver nitrate water solution and 116.6 ml of 1.19 molar potassium bromide water solution under continuous stirring and at the same constant rate, consuming 1.6% of the whole silver nitrate of the emulsion in two minutes. Thereafter, 233.2 ml of a 0.8 molar silver nitrate water solution and 233.2 ml of 1.19 molar potassium bromide water solution were double-jet added at the same constant rate and under stirring in four minutes, consuming 3.2% of the silver nitrate of the formula.

(b) Iodide Precipitation - pBr was adjusted to 1.14 by adding 10 liters of water. 2,200 ml of a 0.8 molar silver nitrate water solution at an accelerated flow rate 5.7x from the beginning to the end (i.e. with a final flow rate 5.7 time higher than the initial one) were double-jet added into the reaction vessel together with 1,300 ml of a water solution of potassium iodide and bromide and ammonium iodide and bromide added at a continuously increasing concentration and a constant flow rate, in 35 minutes consuming 31.2% of the total silver of the formula. This latter solution was obtained by adding under stirring 1,300 ml of a 2.0 molar potassium bromide water solution with 1,300 ml of a 4.9 molar ammonium bromide and 0.55 molar potassium iodide water solution at a 1.6x accelerated flow rate. The resulting solution at increasing bromide and iodide concentrations was added at a constant flow rate to the silver nitrate solution, as said above.

(c) Grain Growth - 4,500 ml of a 0.8 molar silver nitrate water solution were finally single-jet added at an accelerated flow rate 2x from the beginning to the end in 15 minutes till obtaining a pBr=1.57 using 62.3% of the whole silver nitrate of the formula. A total of 5.64 moles of silver nitrate was used. The silver bromo-iodide emulsion comprised 5.5% silver iodide moles.

Washing and Reconstitution - 120 g of a 50% w/w carbamoylated gelatin water solution were added to the emulsion. The coagulum obtained by lowering pH to 4.2 was washed twice with water and reconstituted with 3,650 g of 11% w/w water gelatin.

Emulsion Morphological Characterization The emulsion, examined at a 5,000 enlargement with a SEM (Scanning Electron Microscope), had the following characteristics:

(a) Mean diameter of all crystals prior to iodide precipitation: 0.9 μm
(b) Mean thickness of all crystals prior to iodide precipitation: 0.25 μm
(c) Mean diameter of all crystals: 0.86 μm
(d) Percentage of crystals having a diameter of at least 0.6 μm: 40%
(e) Mean diameter of crystals having a diameter of at least 0.6 μm: 1.38 μm
(f) Mean thickness of the border of crystals having a diameter of at least 0.6 μm: 0.25 μm
(g) Percentage of the projected area of crystals having a diameter of at least 0.6 μm: 73%
(h) Mean aspect ratio of crystals having a diameter of at least 0.6 μm: 5.5:1

At least 30% of the crystals having a diameter of at least 0.6 μm showed a profile along a line on one of the two major faces like that of a concave-shaped surface, with a variation of c-value, measured in the deepest point, in the range from about 25 to 35% the half of the average thickness of the border.

FIG. 1 to 4 reproduce microphotographs of silver bromo-iodide grains of the present invention, chosen to show the concave shape of the major faces of the crystal. The surface of each crystal was examined with a SEM (Scanning Electron Microscopy). When the electronic probe performs the scanning along a line in rectilinear direction on the surface of a single grain and the CRT beam is vertically modulated in proportion to the video signal, the profile along said line can be visualized on the screen, i.e. the thickness variation in the grain along the scanned line can be monitored. Typically, an emulsion sample was treated with enzymes to hydrolize the gelatin. The grains were washed with water and centrifugated. They were then spread on a graphite support, sputtered under vacuum with gold and examined with the SEM. The used SEM was a JEOL 840 manufactured by Jeol Company. A secondary electron negative image of a single grain was focalized on the CRT screen of the instrument using a working power of 15 KV. The horizontal cursor line was moved to the position of interest by turning the Position-Y knob. The CRT intensity was decreased by turning counterclockwise the Bright knob on the Display Mode Unit and the Scan Mode-LSP button was pushed. The brightness on the displayed line profile was adjusted to take a photographic copy of the CRT screen using an Ilford PF4 black-and-white photographic film, having a sensitivity of 125 ASA, exposed for 30 seconds. The obtained photographic copy of the grain was twice reproduced with a 3M DRC Daylight Contact Film to have a contrasted positive image of the grain. This positive image was used to obtain a printing matrix by contact with a conventional pre-sensitized diazo plate. FIGS. 1 to 4 are the offset printing copies obtained with the above matrix according to techniques known in the art. The line profiles shown in the figures were used to evaluate the percent of concavity.

EXAMPLE 2

Photographic Evaluation (Optically Non-Sensitized Emulsion)

114 g of the emulsion described in Example 1, comprising 6.5% of silver, were added with 0.83 mg of $AuCl_3$ and 21.9 mg of KCNS per silver mole, ripened at 55° C. for 130 minutes and added with antifoggants, stabilizers and coating surfactants. The emulsion was then added with 6 g of gelatin dissolved in 113 ml of water and 50 ml of a fine gelatin dispersion of a yellow dye forming coupler comprising 5 g of α-pivaloyl-α-(5-chloro-1,2,4-triazol-1-yl)-5-{γ-(2,4-ditert.-amylphenoxy)-butyramido}-2-chloro-acetanilide as yellow coupler and 2.5 g of gelatin.

The emulsion was then coated onto the subbed side of a cellulose triacetate support base at a silver coverage of 1.2 g/m² and dried.

A sample of the photographic element thus obtained was exposed for 1/50 second to a light source having a color temperature of 5500° K. through a continuous optical wedge. The exposed sample was developed in a standard C41 type processing. The following Table 1 reports the sensitometric results.

TABLE 1

| Fog | Dmax | Sensitivity* | Contrast |
|---|---|---|---|
| 0.06 | 1.23 | 22.5 | 0.40 |

*Sensitivity values read at 0.2 above fog expressed in DIN values.

EXAMPLE 3

Preparation of the Silver Halide Emulsion

A silver halide emulsion was prepared by following the same procedure of Example 1 with the exception of the following changes:

(a) the temperature during the nuclei formation and grain growth steps was 50° C. instead of 80° C., (b) iodide and bromide were added in 45 instead of 35 minutes at the same 1.6x accelerated flow rate, and (c) 0.8 molar water silver nitrate was added at the end in a single jet at the 2x accelerated flow rate from the beginning to the end in 30 minutes till obtaining a pBr of 1.38 using 61.4% of the total silver.

A total of 5.28 moles of silver nitrate was used. The silver bromo-iodide emulsion comprised 6.8% silver iodide moles.

The emulsion was then washed, reconstituted and chemically sensitized as described in Example 1.

Morphological characterization of the emulsion

The emulsion was examined with a SEM (Scanning Electron Microscope) at 5000 enlargements and showed the following characteristics:

(a) Mean diameter of all crystals: 1.7 μm (b) Percentage of crystals having a diameter of at least 0.6 μm: 50%

(c) Mean diameter of crystals having a diameter of at least 0.6 μm: 2.10 μm (d) Mean border thickness of crystals having a diameter of at least 0.6 μm: 0.31 μm (e) Percentage of the projected area of crystals having a diameter of at least 0.6 μm: 77%

(f) Mean aspect ratio of crystals having a diameter of at least 0.6 μm: 6.8:1

At least 30% of crystals having a diameter of at least 0.6 μm showed a profile along a line on one of the major faces like that of a concave-shaped surface having a variation of c-value, measured at the deepest point, from about 20 to 30% the half of the mean border thickness.

EXAMPLE 4

Photographic Evaluation (Blue-Sensitized Emulsion)

772 g of the emulsion of Example 3, comprising 8.5% of silver, were added with sufficient water to give 1,000 g. At pH=6.7, pAg=8.7 and 35° C., the emulsion was added with 76 mg of anhydro-di-3,3'-(γ,γ'-disulfobutyl)-5,5'-dimethoxy-monomethincyanine hydroxide yellow sensitizer, chemically sensitized and then ripened at 55° C. for 150 minutes. 100 g of the emulsion, ripened as described, comprising 7.1% of silver, were added with stabilizers, antifoggants and coating surfactants. The emulsion was then added with 6 g of gelatin dissolved in 115 ml of water and 70 ml of a fine gelatin dispersion containing 7 g of the yellow coupler of Example 2.

The emulsion was then coated onto the subbed side of a cellulose triacetate base as a silver coverage of 1.2 g/m² and dried.

A sample of the photographic element thus obtained was exposed and processed as described in Example 2.

The following Table 2 reports the sensitometric results.

TABLE 2

| Fog | Dmax | Sensitivity* | Contrast |
|---|---|---|---|
| 0.14 | 1.49 | 23.4 | 0.57 |

*Sensitivity values read at 0.2 above fog expressed in DIN values.

EXAMPLE 5

Photographic Evaluation (Green-Sensitized Emulsion)

50 g of a silver bromo-iodide emulsion (comprising octahedric grains having 3.2% of silver iodide and a mean diameter of 0.25 μm, 7.8% of silver and 6.9% of gelatin) and 50 g of a silver bromochloro-iodide emulsion (comprising octahedric grains having 7.1% of silver iodide moles and 5.7% of silver chloride moles and a mean diameter of 0.40 μm, 8% of silver and 6.7% of gelatin), both sensitized with gold and thiosulfate, were added at 35° C. with 4.8 mg of the 5,5'-6,6'-tetrachloro-1,1'-diethyl-3,3'-(3-sulfobutyl)-benzimidazolo-carbocyanine sodium salt green spectral sensitizer, with 32.8 mg of the anhydro-5-chloro-2-{2'-ethyl-3-[5-phenyl-3-(3'-sulfobutyl)-2-benzoxazolinylidene]-propenyl}-3-sulfopropylbenzoxazolium hydroxide green spectral sensitizer, with antifoggants, stabilizers and coating surfactants, with 2.9 g of the 1-(2',4',6'-trichlorophenyl)-3-{3''-(2''',4'''-ditert.-amylphenoxyacetamido)-benzamido}-5-pyrazolone magenta forming coupler dispersed in 41 g of 2.4% gelatin and with 0.38 g of the 1-{4-[α-(2,4-ditert.-amylphenoxy)-butyramido]-phen-pyrazolone magenta forming DIR coupler dispersed in 41 g of 2.4% gelatin. The combined emulsions were coated onto the subbed side of a cellulose triacetate support base at a silver coverage of 2.0 g/m² and a gelatin coverage of 1.5 g/m².

772 g of the emulsion of Example 3 were added with sufficient water to make 1,000 g. At a pH=6.7, pAg=8.7 and 35° C., the emulsion was added with stabilizers and antifoggants, ripened for 30 minutes at 60° C., cooled and washed with water till obtaining a conductivity lower than 800 μS. The emulsion was then chemically sensitized with gold and sulfocyanide salts and ripened at 55° C. for 90 minutes. 97 g of the emulsion, thus ripened, comprising 7.6% of silver, were added at 35° C. with 4 ml of the first above mentioned green sensitizing dye, with 34 g of the second above mentioned green sensitizing dye, with 0.94 g of the above described magenta forming coupler and with 0.04 of the above described magenta forming DIR coupler. The emulsion was coated onto the layer comprising the blended emulsions as described above at a silver coverage of 2.2 g/m$^2$ and a gelatin coverage of 1.5 g/m$^2$ and dried (Present Invention Film).

A second film was then prepared by coating the layer comprising the emulsions blended as described above with a silver bromo-iodide emulsion (comprising octahedrical-shaped thick tabular grains having 7% of silver iodide moles, a mean diameter of 1.2 μm, a mean aspect ratio of the grains having a diameter of at least 0.6 μm equal to 5:1, 7.2% of silver and 5.5% of gelatin) added with the same additions as the emulsion of Example 3 above (Comparison Film).

A sample of each photographic film was exposed and processed as described in Example 2.

Table 3 which follows reports the sensitometric results.

TABLE 3

| Film | Fog | Dmax | Sensitivity* | Contrast |
|---|---|---|---|---|
| Invention | 0.38 | 2.34 | 19.8 | 0.59 |
| Comparison | 0.41 | 2.57 | 19.7 | 0.74 |

*Sensitivity values read a 0.2 above fog expressed in DIN values.

EXAMPLE 6

Preparation of the Silver Halide Emulsion (a) Formation of thick nuclei - 5 liters of a gelatin water solution (containing 170 g of gelatin, 123 g of KBr and 150 g of KCl) at 80° C. and pBr 0.70, contained in a reaction vessel, was double-jet added with 349.8 ml of a 0.8 molar silver nitrate water solution and 217.8 ml of a 2.0 molar potassium bromide water solution in six minutes under continuous stirring and at the same constant rate.

(b) Iodide precipitation - pBr was adjusted at 1.14 by adding 10 l water. 2,000 ml of a 0.8 molar silver nitrate water solution was then double-jet added into the reaction vessel at an accelerated flow rate 5.3x from the beginning to the end (i.e. with a final flow rate 5.3 time higher than the initial one) together with 1,300 ml of a potassium and ammonium iodide and bromide water solution added at a continuously increasing concentration and a constant flow rate, in 35 minutes. This last solution was obtained by adding under stirring 1,300 ml of a 2.0 molar potassium bromide water solution with 1,300 ml of a 4.9 molar ammonium bromide and 0.55 molar potassium iodide water solution at a constant flow rate in 35 minutes. The resulting solution at increasing bromide and iodide concentrations was added at a constant flow rate together with the silver nitrate solution, as said above.

(c) Grain growth - Finally, 4,548 ml of a 0.8 molar silver nitrate water solution were single-jet added at an accelerated flow rate 2.8x from the beginning to the end in 15 minutes till obtaining a pBr of 1.57. A total of 5.64 silver nitrate moles was used. The silver bromo-iodide emulsion comprised 5.5% of silver iodide moles.

Washing and reconstitution - 120 g of 50% w/w carbamoylated gelatin water solution were added to the emulsion. The coagulum obtained by lowering pH to 4.2 was washed twice with water and reconstituted with 3,650 g of 11% w/w aqueous gelatin.

EXAMPLE 7

Preparation of the Silver Halide Emulsion

A silver halide emulsion was prepared by following the same procedure of Example 6 with the following exceptions:

(a) aqueous silver nitrate was added during the iodide precipitation step in 45 minutes instead of 35 minutes at the same accelerated flow rate, (b) the addition of the bromide and iodide salt solutions at a constant flow rate and increasing concentration was realized by using two tanks respectively containing a solution of 1,300 ml of 2.0 molar KBr and a solution of 1,300 ml of 4.9 molar $NH_4Br$ and 0.55 molar KI. Two pumps intook and mixed the two solutions before adding them into the reaction vessel. The addition lasted 45 minutes. The capacity with which the pumps intook the solutions corresponded to the capacities approximated by equations:

$$Q''_t = at^2 + bt + Q'_o$$

wherein $Q'_t$ is the capacity of intake from the first tank containing the bromide solution at a time t, a=0.15625, b=−17.175 and $Q'_o$ is the initial capacity corresponding to 29.0 ml/minute, and $$Q''_t = a't^2 + b't$$

wherein $Q''_t$ is the capacity of intake from the second tank containing the bromide and iodide salt solution in the time, a'=−0.15625 and b'=17.175.

The state of the capacities described in the two above reported equations is represented in the time with two, respectively sinking and rising, complementary parabolas and is such that the total capacity of both solutions in any moment of the addition time corresponds to 29.0 ml/minute. The variation state of the concentration of bromide and iodide salts added into the reaction vessel is substantially equivalent to that realized with the method described in Example

EXAMPLE 8 6.

Reduction of Light Scattering at High Angles

In order to illustrate the reduction of light scattering at high angles of the silver bromo-iodide emulsion of the present invention, the above described method for measuring light angular scattering was used. The silver bromo-iodide emulsion of Example 1 (Emulsion A) was compared with a low aspect ratio silver bromo-iodide emulsion (Emulsion B) and with a high aspect ratio silver bromo-iodide emulsion (Emulsion C). All emulsions were then coated onto a transparent support base at a silver coverage of 1 g/mz The following Table reports the characteristics of the three emulsions.

TABLE 4

| Emulsion | Mean Diameter of the grain μm | Mean aspect ratio |
|---|---|---|
| A | 1.38 | 5.5:1 |
| B | 1.52 | 5.0:1 |

TABLE 4-continued

| Emulsion | Mean Diameter of the grain μm | Mean aspect ratio |
|---|---|---|
| C | 1.20 | 22.0:1 |

Figure 5:
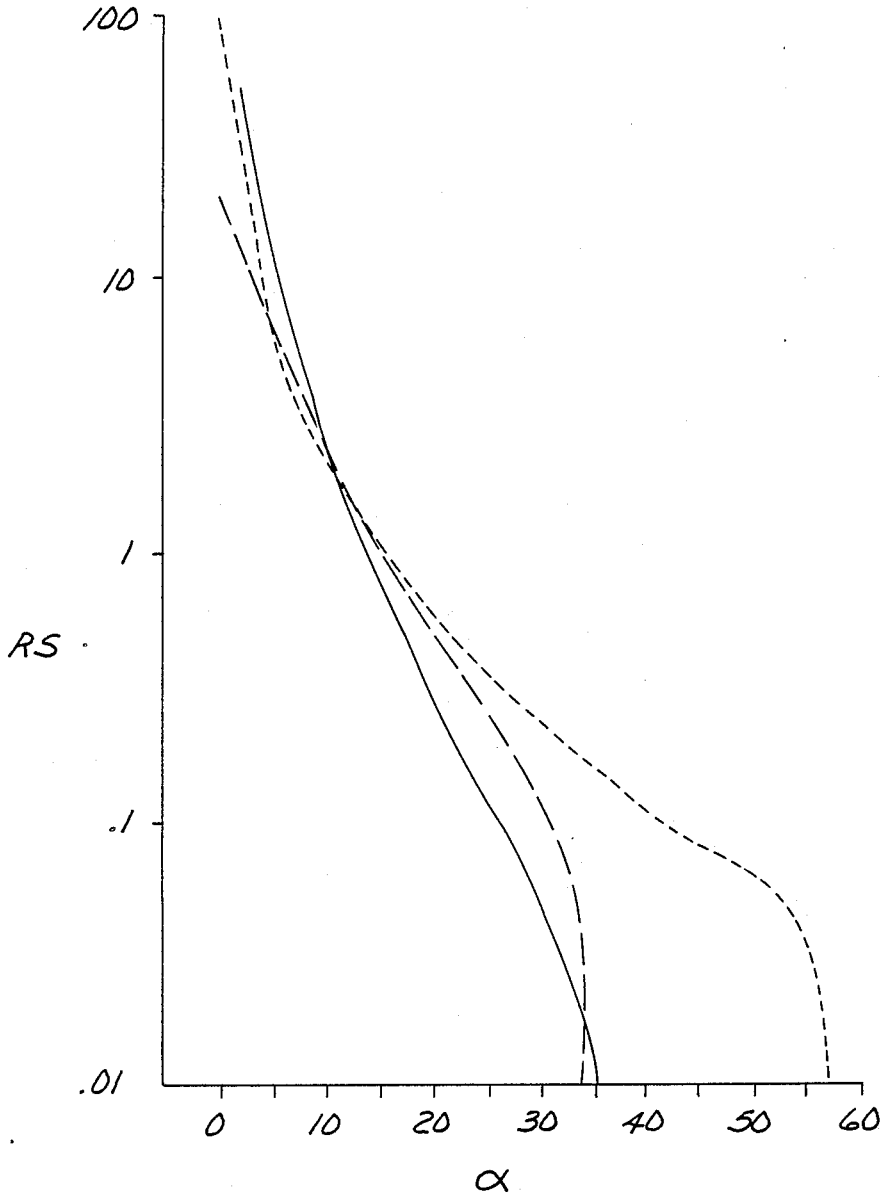

FIG. 5 is a graph reporting the relative signals (RS) of the detected light with respect to the detection angles (α). Emulsion A of the present invention (continuous line) has a light scattering which can be compared with that of high aspect ratio tabular grain Emulsion C (dashed line) and is substantially better than that of low aspect ratio tabular grain Emulsion B (dotted line).

I claim:

1. A light-sensitive emulsion comprising a dispersing medium and silver halide grains, characterized by the fact that at least 10% of the total projected area of the silver halide grains consists of silver bromo-iodide grains bound by at least one substantially concave-shaped major face, said grains having a diameter of at least 0.6 μm and the half of their thickness in the deepest point of said concavity lower than 80% the half of their border thickness.

2. The light-sensitive emulsion of claim 1 wherein at least 30% of the total projected area of the silver halide grains consists of said silver bromo-iodide grains.

3. The light-sensitive emulsion of claim 1, wherein said silver bromo-iodide grains have a border thickness of at least 0.15 μm.

4. The light-sensitive emulsion of claim 1, wherein said silver bromo-iodide grains have a border thickness lower than 0.4 μm.

5. The light-sensitive emulsion of claim 1, wherein said half thickness in the deepest point of said concavity is lower than 60% the half of the their border thickness.

6. The light-sensitive emulsion of claim 1, wherein the mean aspect ratio of said bromo-iodide grains is at least 2:1.

7. The light-sensitive emulsion of claim 1, wherein the mean aspect ratio of said bromo-iodide grains is lower than 10:1.

8. The light-sensitive emulsion of claim 1, wherein the concavity ratio c/a of the silver bromo-iodide grains, wherein a is the longest axis and c is the shortest semi-axis of the flattened semi-ellipse equivalent to the concavity, meets the condition $1/100<c/a<1/4$.

9. The light-sensitive emulsion of claim 1, wherein the shortest semi-axis of the semi-ellipse equivalent to the concavity of the silver bromo-iodide grain and the border b thickness of said grains meet the condition $c>b/10$.

10. The light-sensitive emulsion of claim 1, wherein the shortest semi-axis of the flattened semi-ellipse equivalent to the concavity of the silver bromo-iodide grain and the border b thickness of said grains meet the condition $c<b/2$.

11. The light-sensitive emulsion of claim 1, where in said silver bromo-iodide grains there is present iodide in concentrations up to 20% moles.

12. The light-sensitive emulsion of claim 1, wherein the dispersing medium is gelatin or a gelatin derivative.

13. The light-sensitive emulsion of claim 1, wherein said silver halide grains are chemically sensitized.

14. The light-sensitive emulsion of claim 1, wherein said silver bromo-iodide grains are chemically sensitized with sensitizers deriving from noble metals, intermediate chalcogens, reduction sensitizers or combinations thereof.

15. The light-sensitive emulsion of claim 1 wherein said silver bromo-iodide grains are spectrally sensitized.

16. The light-sensitive emulsion of claim 1, wherein said silver bromo-iodide grains have at least one sensitizer dye of the cyanine, merocyanine, hemicyanine, hemioxonol or merostyryl type adsorbed on their surface.

17. A photographic element which comprises a support base and at least one silver halide emulsion layer comprising the emulsion of claim 1.

18. The photographic element of claim 17 wherein at least 30% of the total projected area of the silver halide grains consists of said silver bromo-iodide grains.

19. The photographic element of claim 17, wherein said silver bromo-iodide grains have a border thickness of at least 0.15 μm.

20. The photographic element of claim 17, wherein said silver bromo-iodide grains have a border thickness lower than 0.4 μm.

21. The photographic element of claim 17, wherein said half thickness in the deepest point of said concavity is lower than 60% the half of the their border thickness.

22. The photographic element of claim 17, wherein the mean aspect ratio of said bromo-iodide grains is at least 2:1.

23. The photographic element of claim 17, wherein the mean aspect ratio of said bromo-iodide grains is lower than 10:1.

24. The photographic element of claim 17, wherein the concavity ratio c/a of the silver bromo-iodide grains, wherein a is the longest axis and c is the shortest semi-axis of the flattened semi-ellipse equivalent to the concavity, meets the condition $1/100<c/a<1/4$.

25. The photographic element of claim 17, wherein the shortest semi-axis of the semi-ellipse equivalent to the concavity of the silver bromo-iodide grain and the border b thickness of said grains meet the condition $c>b/10$.

26. The photographic element of claim 17, wherein the shortest semi-axis of the flattened semi-ellipse equivalent to the concavity of the silver bromo-iodide grain and the border b thickness of said grains meet the condition $c<b/2$.

27. The photographic element of claim 17, where in said silver bromo-iodide grains there is present iodide in concentrations up to 20% moles.

28. The photographic element of claim 17, wherein the dispersing medium is gelatin or a gelatin derivative.

29. The photographic of claim 17, wherein said silver halide grains are chemically sensitized.

30. The photographic element of claim 17, wherein said silver bromo-iodide grains are chemically sensitized with sensitizers deriving from noble metals, intermediate chalcogens, reduction sensitizers or combinations thereof.

31. The photographic element of claim 17 wherein said silver bromo-iodide grains are spectrally sensitized.

32. The photographic element of claim 17, wherein said silver bromo-iodide grains have at least one sensitizer dye of the cyanine, merocyanine, hemicyanine, hemioxonol or merostyryl type adsorbed on their surface.

33. A multicolor photographic element which comprises a support base and, coated thereon, silver halide emulsion layers to separately record blue, green and red light, each comprising a dispersing medium and silver halide grains, characterized by the fact that at least one emulsion layer comprises an emulsion according to claim 1.

34. The multicolor photographic element of claim 33 wherein at least 30% of the total projected area of the silver halide grains consists of said silver bromo-iodide grains.

35. The photographic element of claim 33 wherein said silver bromo-iodide grains have a border thickness of at least 0.15 μm.

36. The photographic element of claim 33 wherein said silver bromo-iodide grains have a border thickness lower than 0.4 μm.

37. The photographic element of claim 33 wherein said half thickness in the deepest point of said concavity is lower than 60% the half of the their border thickness.

38. The photographic element of claim 33 wherein the mean aspect ratio of said bromo-iodide grains is lower than 10:1.

39. The photographic element of claim 33 wherein at least one emulsion layer comprises a first silver halide emulsion layer positioned to receive specularly transmitted light and further silver halide emulsion layers positioned to receive light transmitted through said first silver halide emulsion layer, wherein at least first silver halide emulsion layer contains chemically and spectrally sensitized silver bromo-iodide grains bounded by at least one substantially concave-shaped major face and having a diameter of at least 0.6 μm and the half of their thickness, in the deepest point of said lower concavity, 80% of the half of their border thickness and forming at least 10% of the total projected area of the silver halide grains in said layers.

40. The photographic element of claim 33 wherein the silver halide emulsion layer containing said silver bromo-iodide grains is the outermost emulsion layer of the photographic element.

41. A multi-step process for preparing an emulsion of light-sensitive silver halide grains dispersed in a hydrophilic dispersing medium which comprises a first double-jet precipitation step for the formation of silver halide growing nuclei, a second double-jet precipitation step of first diameter growth of said nuclei and a third step of grain second growth by means of single-jet solution of silver salts, characterized by the fact that (a) said first precipitation step for the formation of growing nuclei occurs at a constant pBr ranging from 0.6 to 1.2 in the presence of a soluble chloride to form thick silver halide nuclei, (b) said second step of first growth occurs by adding a first jet of a soluble silver salt water solution at constant concentration and accelerated flow rate and a second jet of a bromide and iodide soluble salt water solution at increasing concentrations of bromide and iodide and constant flow rate at a pBr decreasing from about 1.2 to about 0.6, and (c) said third step of second growth is performed till increasing pBr above 1.2.

42. The process of claim 41 wherein the reaction vessel during step (a) comprises said water soluble chloride salts in a quantity from 0.02 to 0.15 moles per mole of silver salt.

43. The process of claim 41 wherein from 1 to 10% of all silver salt is added during step (a).

44. The process of claim 41 wherein from 10 to 40% of all silver salt is added during step (b).

45. The process of claim 41 wherein from 50 to 88% of all silver salt is added during step (c).

46. The process of claim 41 wherein the reaction vessel prior to the introduction of silver and bromide salts is substantially free of iodide.

47. The process of claim 41 wherein the content of the reaction vessel, during the introduction of silver, bromide and iodide salts, is kept at a temperature from 30° to 90° C.

48. The process of claim 41 wherein the thick silver bromide nuclei of step a) have a mean diameter from 0.2 to 1 μm.

49. The process of claim 41 wherein the silver bromide nuclei of step (a) have a mean aspect ratio lower than 8:1.

50. The process of claim 41 wherein at least 10% of the total projected area of silver bromo-iodide grains consists of silver bromo-iodide grains bound by at least one substantially concave-shaped major face, said grains having a diameter of at least 0.6 μm and the half of their thickness in the deepest point of said concavity lower than 80% the half of their border thickness.

* * * * *

UNITED STATES PATENT AND TRADEMARK OFFICE

CERTIFICATE OF CORRECTION

PATENT NO. : 4,952,489

DATED : August 28, 1990

INVENTOR(S) : Amicucci

It is certified that error appears in the above-identified patent and that said Letters Patent is hereby corrected as shown below:

Column 16, line 58, "1-{4-[α-(2,4-ditert-amylphenoxy)-butyramido]-phenpyrazolone" should be -- 1-{4-[α-(2,4-ditert-amylphenoxy)-butyramido]-phenyl}-3-pyrrolidino)-4-(1-phenyl-5-tetrazolylthio)-5-pyrazolone --.

Column 18, line 26, " $Q''_t=at^2+bt+Q'_o$ " should be

-- $Q'_t=at^2+bt+Q'_o$ --.

Column 18, line 47, "Example" should be --Example 6.--.

Column 18, line 48, "EXAMPLE 8 6." should be --EXAMPLE 8--.

Column 18, line 62, "g/mz" should be --$g/m^2$--.

Signed and Sealed this

Seventh Day of April, 1992

*Attest:*

HARRY F. MANBECK, JR.

*Attesting Officer*

*Commissioner of Patents and Trademarks*